US011412833B1

(12) United States Patent
Zheng et al.

(10) Patent No.: US 11,412,833 B1
(45) Date of Patent: Aug. 16, 2022

(54) COSMETIC PACKAGE FOR A FLUID PRODUCT

(71) Applicant: APR Beauty Group Inc, Toronto (CA)

(72) Inventors: Min-Yan Zheng, Toronto (CA); Feng-Ying Fu, Markham (CA); Jun Shen, Lighthouse Point, FL (US)

(73) Assignee: APR Beauty Group, Inc., Toronto (CA)

( * ) Notice: Subject to any disclaimer, the term of this patent is extended or adjusted under 35 U.S.C. 154(b) by 0 days.

(21) Appl. No.: 17/401,480

(22) Filed: Aug. 13, 2021

(51) Int. Cl.
*A45D 34/04* (2006.01)

(52) U.S. Cl.
CPC ..... *A45D 34/042* (2013.01); *A45D 2200/15* (2013.01); *A45D 2200/155* (2013.01)

(58) Field of Classification Search
CPC ..... A45D 34/042; A45D 40/262; A45D 2200/155; A45D 2200/15; A45D 2200/1018
USPC ..... 401/261–267, 1, 2
See application file for complete search history.

(56) References Cited

U.S. PATENT DOCUMENTS 8,292,535 B2 * 10/2012 Thorpe ..... A45D 34/04 401/265
8,573,874 B2 * 11/2013 Neuner ..... A45D 34/04 401/265
9,565,920 B2 * 2/2017 Thorpe ..... A45D 34/041
2007/0186951 A1 * 8/2007 Gueret ..... A45D 34/00 132/320
2011/0103878 A1 * 5/2011 Neuner ..... A45D 40/26 401/203

* cited by examiner

*Primary Examiner* — David J Walczak
(74) *Attorney, Agent, or Firm* — Jason Lee DeFrancesco

(57) ABSTRACT

A cosmetic package for dispensing and applying a fluid product, comprising a housing for storing the fluid product and an applicator head coupled to one end of the housing. The applicator head comprises a dispensing member and a thermal member. A portion of the applicator head is formed as an applicator tip that is adapted to apply and dispense the fluid product. The applicator tip includes a first face and a second face opposing the first face. The first face includes a dispensing opening of the dispensing member and at least a portion of thermal member. The second face is defined by the thermal member alone. The thermal member made is of a material capable of holding and retaining a thermal charge and is selected from a group materials consisting of metals, metal alloys, stones, ceramics, high-density plastics, and composites.

21 Claims, 7 Drawing Sheets

COSMETIC PACKAGE FOR A FLUID PRODUCT

BACKGROUND

Field

The present disclosure relates to a cosmetic package for a fluid product, such as a cosmetic product. More particularly, the cosmetic package includes an applicator tip at least partially made of a thermal material which offers a thermal effect to create a cold sensation upon application.

Description of the Related Art

There are packages for the distribution of cosmetic and medicinal products. Such packages usually consist of an outer shell or tubular casing, a dispensing mechanism for moving cosmetic or medicinal products, and an applicator tip. For example, in the medical industry, applicators are used to apply medicinal products such as ointments to parts of the body. In the cosmetics and personal care industry, applicators are used to apply lipstick, lip balm, skin creams, lotions and other cosmetic products to parts of the body.

In many cases, these medicinal and cosmetic products may include skincare substances such as aloe vera or lanolin, which provide a healing or therapeutic effect to heal damaged skin or maintain healthy skin. In addition, these products may include therapeutic substances such as local anesthetics, painkillers, fragrances, menthol, or other substances that provide a supple or stimulating sensation when applied to the skin of a skin user. In addition to skincare substances, heat treatments (for example the application of heat and/or cold) are known to relieve pain, to provide a therapeutic sensation, and to slow down the body's natural response to injury resulting in a slower and more controlled healing process.

In the fields of cosmetics and pharmacy, fluid dispensers already exist comprising a fluid reservoir associated with a rigid and heat-transfer dispenser head for putting into contact with the skin, in particular the skin of the face. Documents US20110103878A1, U.S. Pat. No. 8,573,874B2, and U.S. Pat. No. 8,292,535B2 are known, for example. The head forms an applicator pad from which a dispenser opening opens out. The user actuates the dispenser so as to dispense a dose of fluid, and then spreads it by means of the applicator pad which provides a massaging effect and above all a cold sensation on contact with the skin which is very pleasant.

In document U.S. Pat. No. 8,292,535B2, the pad that is made of metal or ceramic defines a borehole in which a plastics insert is received that forms an outlet duct and the dispenser opening. As a result, the fluid that is dispensed is never in contact with the borehole, but the opening is visibly formed by a part (the insert) that is distinct from the pad, which is not particularly attractive.

In documents US20110103878A1 and U.S. Pat. No. 8,573,874B2, the pad includes a frustoconical dispenser passage defining, on its inner face, a very wide inlet, and on its outer face, a dispenser opening. The fluid that is dispensed comes into contact with the entire frustoconical passage and cools on contact therewith. It can also be said that the fluid heats the pad as a result of extended contact. In the present invention, the fluid comes into contact with the dispenser passage, as in the above-mentioned documents US20110103878A1 and U.S. Pat. No. 8,573,874B2.

Still, there is a need for an applicator head that is capable of providing a thermal treatment to user's skin on both a smaller and a larger application area effectively.

SUMMARY

It is an object of the present disclosure to provide a cosmetic package for dispensing a fluid product.

It is an object of the present disclosure to provide a cosmetic package with an applicator head having an applicator tip with thermal capacity, which is capable of retaining and transferring thermal energy.

It is an object of the present disclosure to provide an applicator tip allowing a fluid product to be applied locally or topically to a selected area of a keratin surface and providing a thermal sensation to the keratin surface.

It is an object of the present disclosure to provide an applicator tip which offers a comparatively large surface area, very simple to use, economical to manufacture, and aesthetically pleasing.

Further, an applicator tip is desired which is comfortable and easier to use.

Accordingly, there is provided a cosmetic package comprises a cap, a housing, and an applicator head. The housing comprises a reservoir for containing a fluid product including a cosmetic, care, or pharmaceutical product. The cosmetic, care or pharmaceutical product includes viscous cosmetics, mascara, eyebrow powder, lip gloss, hair color, cheek blush, skincare, under eye cosmetics, pharmaceutical, and like products.

According to a preferred embodiment of the present disclosure, the cosmetic package comprises a housing, an applicator head coupled to one end of the housing, and a cap configured to be coupled to the housing when the cosmetic package is not in use. This cosmetic package extends longitudinally. The housing comprises a reservoir for containing a fluid product including a cosmetic, care, or pharmaceutical product. The cosmetic, care, or pharmaceutical product includes viscous cosmetics, mascara, eyebrow powder, lip gloss, hair color, cheek blush, skin #care, under eye cosmetics, pharmaceutical, and like products.

According to an aspect of the present disclosure, a portion of the applicator head is formed as an applicator tip that is adapted to apply and dispense the fluid product. The applicator tip formed at an upper portion of the applicator head. The applicator tip includes two main faces namely, a first face and a second face opposing the first face.

Further, the applicator head is made of a dispensing member and a thermal member. The thermal member and at least an upper portion of the dispensing member together define the applicator tip. The dispensing member includes a product delivery passageway for the cosmetic product in communication with the housing. The product delivery passageway extends through the dispensing member and ends in dispensing opening on the first face of the applicator head that is adapted to dispense and apply the fluid product on the surface to be treated.

According to another aspect of the present disclosure, the dispensing member comprises a lower portion that is configured to be connected to housing, a middle portion that forms a neck portion of the applicator head, and an upper portion of the dispensing member that forms a portion of the applicator tip.

According to an aspect of the present disclosure, the lower portion of the dispensing member is cylindrical. The middle portion of the dispensing member gradually tapers asymmetrically from a proximal end thereof up to a certain distance forming a thin neck that is off-centered with respect to a longitudinal axis of the cosmetic package. The upper portion of the dispensing member includes a distal end face that is inclined with respect to a longitudinal axis of the dispensing member and faces the second face of the applicator tip. A surface opposing the distal end face forms a portion of the first face and includes the dispensing opening.

According to yet another aspect of the present disclosure, the thermal member is attached to the dispensing member on the distal end face of the dispensing member. The thermal member has a tear-shaped body. In a preferred embodiment, the tear-shaped body of the thermal member has an upper surface that is convex and a bottom surface that is flat. The upper surface of the thermal member forms the second face of the applicator tip intended to be applied on the user's surface to be treated. In addition, the second face is adapted to perform, if necessary, a massage on the treated area. The second face is available for use as a free, unhindered surface that can be entirely brought into contact with the part of the skin to be treated for the application of the cosmetic. Further, the thermal member may be of any shape as long as it provides a relatively large continuous application area. In other words, the shape of the thermal member may be constructed in any form and any suitable size with suitable mass and volume for the application purpose onto the user's keratinous surfaces.

In the preferred embodiment, a portion of a peripheral edge of the thermal member is rounded for comfort during the application. In alternate embodiments, the peripheral edge of the thermal member may not be rounded.

According to yet another aspect of the present disclosure, the thermal member protrudes from the distal end face on at least three sides and most preferably at least extend beyond a top portion of a peripheral edge of the distal end face of the dispensing member forming a protruded thermal portion. In alternate embodiments, the thermal member protrudes from the distal end face of the dispensing member all the way around, i.e. on all sides.

The thermal member may be secured to on the distal end face of the dispensing member, for example, by a press-fit, snap-fit, adhesive, and/or engagement by one or more engagement features or by any other means of engagement known in the art. In the exemplary embodiment, the distal end face of the dispensing member includes at least coupling one protrusion, preferably at least two coupling protrusions that are received in corresponding at least two coupling grooves present at the bottom surface of the thermal member, in order to snap couple the thermal member with the dispensing member. The two coupling protrusions may be closely spaced or remotely spaced from each other. Additionally, each coupling protrusion primarily secures precisely by means of snap or interference/fitment with the respective coupling groove.

In a preferred embodiment, the thermal member includes the two coupling grooves that extend longitudinally, and they extend from the bottom surface to a certain depth. Additionally, the two coupling grooves can be constructed of any diameter and depth. Further, the thermal member may be of any shape or include various structures.

According to yet another aspect of the present disclosure, the dispensing member comprises the dispensing opening near a distal end of the dispensing member on the first face of the applicator tip. The outer surface surrounding the dispensing opening near a distal end of the dispensing member on the first face is protruded, thus the dispensing opening in the present embodiment is a protruded dispensing opening. A protruded thermal portion of the thermal member that extends beyond a top peripheral edge of the distal end face of the dispensing member together with the protruding dispensing opening defines the first face of the applicator tip. The protruding dispensing opening lies close below the protruded thermal portion of the thermal member. Thus, during the application, when the fluid product is applied from the dispensing opening, both the protruded dispensing opening and the protruded thermal portion of the thermal member of the first face come in contact with the user's target area for application. The first face thus may be used for applying the dispensed fluid product and as well as providing thermal sensation to the user's skin. Thus, in the exemplary embodiment, the first face wherein the protruded thermal portion is configured in such a way that it preferably touches/contacts the user's keratinous surface and provides thermal massage i.e., heating or cooling on to the keratinous surface during or after dispensing of the fluid product from the dispensing opening.

In particular, the applicator tip thus comprises two faces i.e. the first face and the second face. More particularly, the first face consists of the protruded thermal portion defined at top of the applicator tip and at least one dispensing opening placed below the protruded thermal portion. Further, the second face is a thermal surface that is on the opposite side of the first face. The second face is a thermal surface that allows the users to massage a larger area of the keratinous surface.

The protruded thermal portion of the thermal member enables precise massage of small or narrow areas of the user's keratinous surface such as upper lips, under eye, etc. Herein, the disclosed protruded thermal portion of the thermal member at the top of the dispensing member is a continuous surface. The protruded thermal portion of the thermal member is substantially in axial alignment with the protruded dispensing opening and thus allowing the user to massage the small or narrow areas of a keratinous surface while dispensing the fluid product on to the user's keratinous surface.

The thermal member is made of a material with high thermal effusivity compared to that of the user's surface to be treated. The thermal effusivity of the thermal member is higher than that of pensing member. Thermal Effusivity is the capacity of a material to absorb calories. The more its value is high, the more the material is adapted to absorb calories without overheating and conversely. The intrinsic value of the Thermal Effusivity of a material is calculated in the following manner:

$$Ef=\sqrt{k\cdot p\cdot c}$$

Where K is the thermal capacity in $W\cdot m^{-1}\cdot{}^{o}\ K^{-1}$; p is the density in kg/m3; c is the thermal conductivity in $J\cdot kg^{-1o}\cdot K^{-1}$ Thus, upon contact with the skin, while all parts are at the same temperature, a part made of steel (Effusivity of which is in the order of 14000 $J\cdot K^{-1}\cdot m^{-2}\cdot s^{-12}$) will provide a cold sensation on the skin (Effusivity of 400 $J\cdot K^{-1}\cdot m^{-2}\cdot s^{-12}$), while a part made of wood (Effusivity likewise in the order of 400 $J\cdot K^{-1}\cdot m^{-2}\cdot s^{-1/2}$) will provide a neutral sensation. This heat transfer provides a cold sensation on the skin which intensifies as the thermal effusivity increases.

Further, thermal member made of a material capable of holding and retaining a thermal charge. In one implementation, the thermal member can be made of stainless steel. However, in other implementations, any suitable material may be used that is capable of retaining heat or cold during the application of the fluid product. Examples of other suitable materials include, without limitation, metals (e.g., aluminum, titanium, steel, nickel, tin, copper, brass, alloys thereof, etc.) stones, ceramics, high-density plastics, composites, or the like.

The dispensing member may be made of a thermoplastic polymer, for example, which is non-reactive with the fluid product stored in the reservoir. In other implementations, the dispensing member may be made of virtually any other material that is non-reactive or resistant to the fluid product being dispensed, such as various metals, plastics, ceramics, composites, or the like.

In an implementation, the thermal member is a tear-drop shaped body. In alternate embodiments, however, the thermal member may be constructed in any other suitable shape and size and may have any suitable mass, surface finish desired for a given application. For example, the thermal member may be a flat or essentially flat plate.

According to yet another aspect of the present disclosure, at least a portion, preferably a major portion of the product delivery passageway, which forms a dispensing path for the product in housing, is off-centered and parallel to the longitudinal axis of the cosmetic package. A distal portion of the product delivery passageway is non-parallel to the longitudinal axis of the cosmetic package, preferably the distal portion of the product delivery passageway is slanted and opens into the dispensing opening on the first face.

The distal end face of the dispensing member makes an angle θ with respect to a longitudinal axis of the dispensing member. In a preferred implementation, the angle θ is about 35°. This design facilitates application of the thermal member to the user's skin. However, other designs may be used. For example, in other implementations, the angle θ may be between about 100 and about 80°.

The cosmetic package further includes a cap made up of glass or plastic with protrusions at an inner surface of a lower portion of a sidewall of the cap. Advantageously, each protrusion gets in snap-fit connection with a corresponding protrusion present on an outer surface of the support body. In alternate embodiments, the cap and the housing may be coupled. The coupling means between the cap and the support body/housing may by any other engagement means capable of removably coupling the cap and the support body/the housing for e.g. j-lock, magnetic engagement, screw threads etc.

According to yet another aspect of the present disclosure, the cosmetic package according to an exemplary embodiment further includes the housing, a support body, a pumping member, a contents movement part, and a button formed on an outer surface of the middle portion of the dispensing member.

According to yet another aspect of the present disclosure, the housing is provided with a coupling part at an upper portion thereof for coupling with a support body. The support body includes a coupling part, coupled to the coupling part at an upper portion of the housing. The support body is configured to support a pumping member, is provided with a hollow for coupling with a pumping member.

The pumping member is coupled to the support body and performs a pumping operation for discharging fluid product stored in the housing to the outside. The pumping member further includes a cup-shaped body, an annular fluid-tight piston, a check valve, a spring, and a hollow elongated stem. The check valve is disposed on a proximal end of the cup-shaped body. The check valve allows a one-way suction of the fluid product stored inside the housing, wherein the one-way suction is typically from the proximal end to the distal end of the pumping member. The pumping member comprises the cup-shaped body delimiting a chamber for suction/compression of the fluid product to be dispensed, in which the hollow stem extends at least partially.

According to yet another aspect of the present disclosure, the support body includes an upper sidewall that encases the pumping member at an upper portion of the housing. The upper sidewall of the support body comprises a button insertion hole such that when button is pressed the lower portion of the dispensing member can be slidably inserted therein.

According to yet another aspect of the present disclosure, the contents movement part is disposed at an upper portion of the pumping member at an inner side of lower portion of the dispensing member, and moving fluid product which move to an upper portion thereof through a pumping operation of the pumping member to the dispensing opening. The contents movement part comprises a body encasing an upper portion of the pumping member; a button fixation protrusion extending from an upper surface of the body to an upward direction and fixes to the inner side of the lower portion of the dispensing member; a movement tube provided with a passage where fluid product flowing out by a pumping operation of the pumping member move; and movement tube guides the movement of fluid product so as to move the fluid product flowing in by a pumping operation of the pumping member to the product delivery passageway.

The movement tube of the contents movement part is coupled to an upper portion of the pumping member and communicates with the pumping member.

When a contents movement part moves to a downward direction by pressurization of the button formed on the outer surface of the middle portion of the dispensing member, the fluid product is discharged by a pumping action of the pumping member, and the fluid product is discharged to the outside on the first face through the dispensing opening.

The lower portion of the dispensing member, inserted into a button insertion hole of the support body and descends by the user's pressing, and then ascends by an elastic force of the spring of the pumping member when the pressing is released. Next, when the button is released from being pressurized, the contents movement part ascends by the spring of the pumping member and restores the button coupled to an upper portion of the contents movement part to the original place.

According to yet another aspect of the present disclosure, a piston member is sealingly and slidingly received in the housing. The piston member is movable along the longitudinal axis in the housing in response to the pumping action and reaches near an open proximal end of the housing when the fluid product inside the housing is completely used.

In a preferred embodiment discussed above, the delivery mechanism for dispensing fluid product is an airless pump. However, in other implementations, any suitable delivery mechanism may be used.

The following is a discussion of examples, without limitation, of delivery mechanisms for dispensing a product. The first example may be implemented using a click or a reverse click operation, whereby the user may operate the cosmetic package by moving the applicator head relative to the housing in either a clockwise or counterclockwise direction.

Another example delivery mechanism for dispensing the fluid product may be a squeeze operation. In certain embodiments wherein the delivery mechanism is a squeeze operation, when pressure is applied to the housing containing the reservoir, the fluid product in the reservoir may be forced, by the squeezing action, through the cosmetic package via a product delivery passageway for application to the user's skin.

In yet another example, a delivery mechanism for dispensing the fluid product may be by a pressurized dispenser, such as an aerosol dispenser. In certain embodiments wherein the delivery mechanism is an aerosol delivery mechanism, the composition will be held under pressure in a container and will be dispersed along with an aerosol propellant in response to actuation by a user. Actuation may be by depressing, rotating, tilting, or otherwise manipulating the applicator head, pressing a button, and/or by any other suitable dispensing mechanism. Details of the construction and propellant of an aerosol dispenser are within the skill of one of ordinary skill in the art and will, therefore, not be described in detail herein.

According to an aspect of the present disclosure, the cosmetic package is of an elongated cylindrical configuration. However, in alternate embodiments, the cosmetic package may be of an elongated square, polygonal configuration, oval, triangular, heart, or any other configuration known in the art.

The present disclosure is not limited to, the broadest in accordance with the basic idea disclosed herein. It should be interpreted as having a range. Skilled artisans may implement the pattern of the non-timely manner by combining, replacement of the disclosed embodiments shape, this would also do not depart from the scope of the disclosure. In addition, those skilled in the art may readily change or modify to the disclosed embodiments, based on the present specification, such changes or modifications also belong to the scope of the present disclosure will be apparent.

BRIEF DESCRIPTION OF THE DRAWINGS

A more complete appreciation of the present disclosure and many of the attendant advantages thereof will be readily obtained as the same becomes better understood by reference to the following detailed description when considered in connection with the accompanying drawings, wherein.

DETAILED DESCRIPTION

Figure 1:
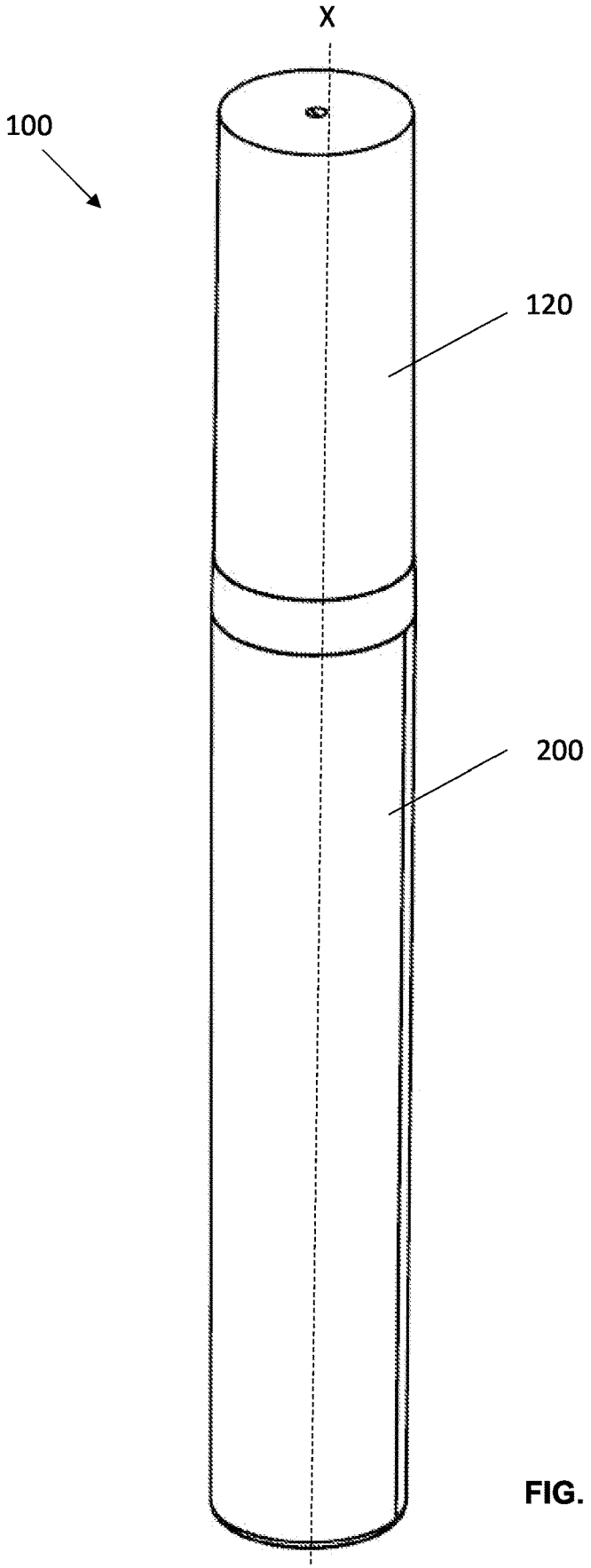
FIG. 1 illustrates an isometric view of a cosmetic package according to a preferred embodiment of the present disclosure.

As shown throughout the drawings, like reference numerals designate like or corresponding parts. While illustrative embodiments of the present disclosure have been described and illustrated above, it should be understood that these are exemplary of the disclosure and are not to be considered as limiting. Additions, deletions, substitutions, and other modifications can be made without departing from the spirit or scope of the present disclosure. Accordingly, the present disclosure is not to be considered as limited by the foregoing description.

Throughout this specification, the terms "comprise," "comprises," "comprising" and the like, shall consistently mean that a collection of objects is not limited to those objects specifically recited.

Figure 2:
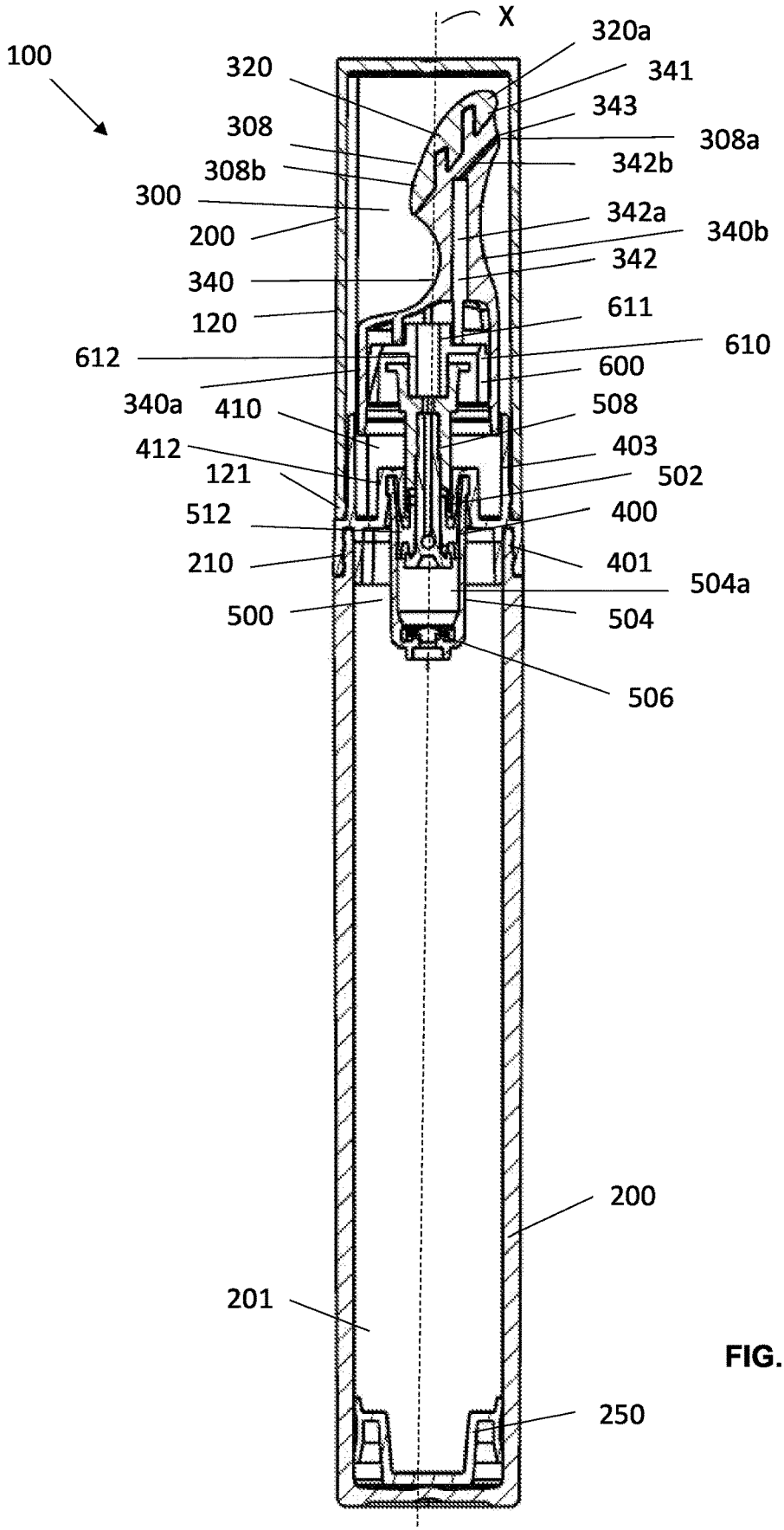
FIG. 2 illustrates a longitudinal cross sectional view of the cosmetic package of FIG. 1.
Figure 3:
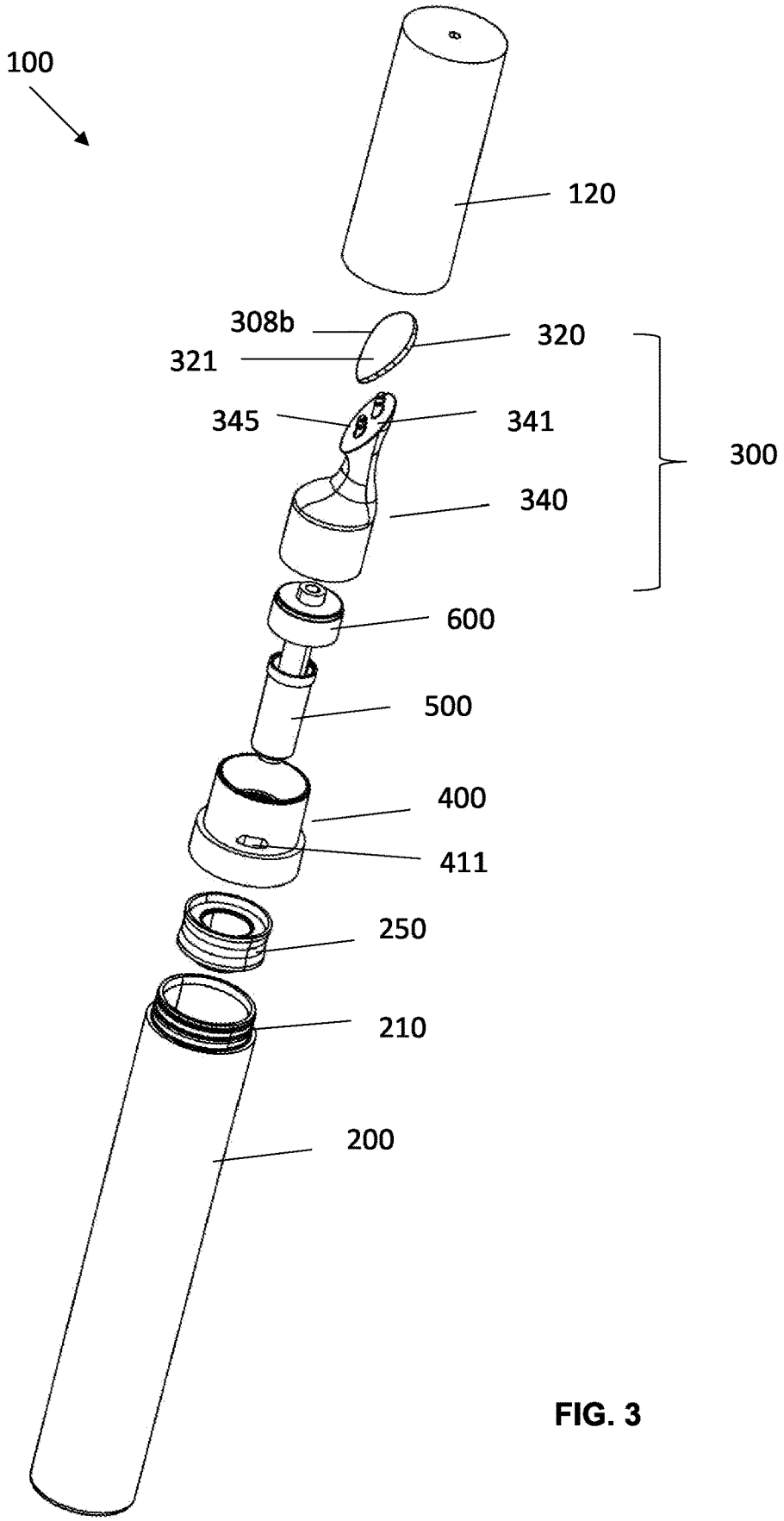
FIG. 3 illustrates an isometric exploded view of the cosmetic package of FIG. 1.

FIGS. 1 to 3 show an illustrative cosmetic package 100 according to a preferred embodiment of the present disclosure. The cosmetic package 100 comprises a housing 200, an applicator head 300 coupled to one end of the housing 200, and a cap 120 configured to be coupled to the housing 200 when the cosmetic package is not in use. This cosmetic package 100 extends longitudinally along a longitudinal X-axis. The housing 200 comprises a reservoir 201 for containing a fluid product (not shown) including a cosmetic, care or pharmaceutical product. The cosmetic, care or pharmaceutical product includes viscous cosmetics, mascara, eyebrow powder, lip gloss, hair color, cheek blush, skin care, under eye cosmetics, pharmaceutical, and like products.

Figure 4:
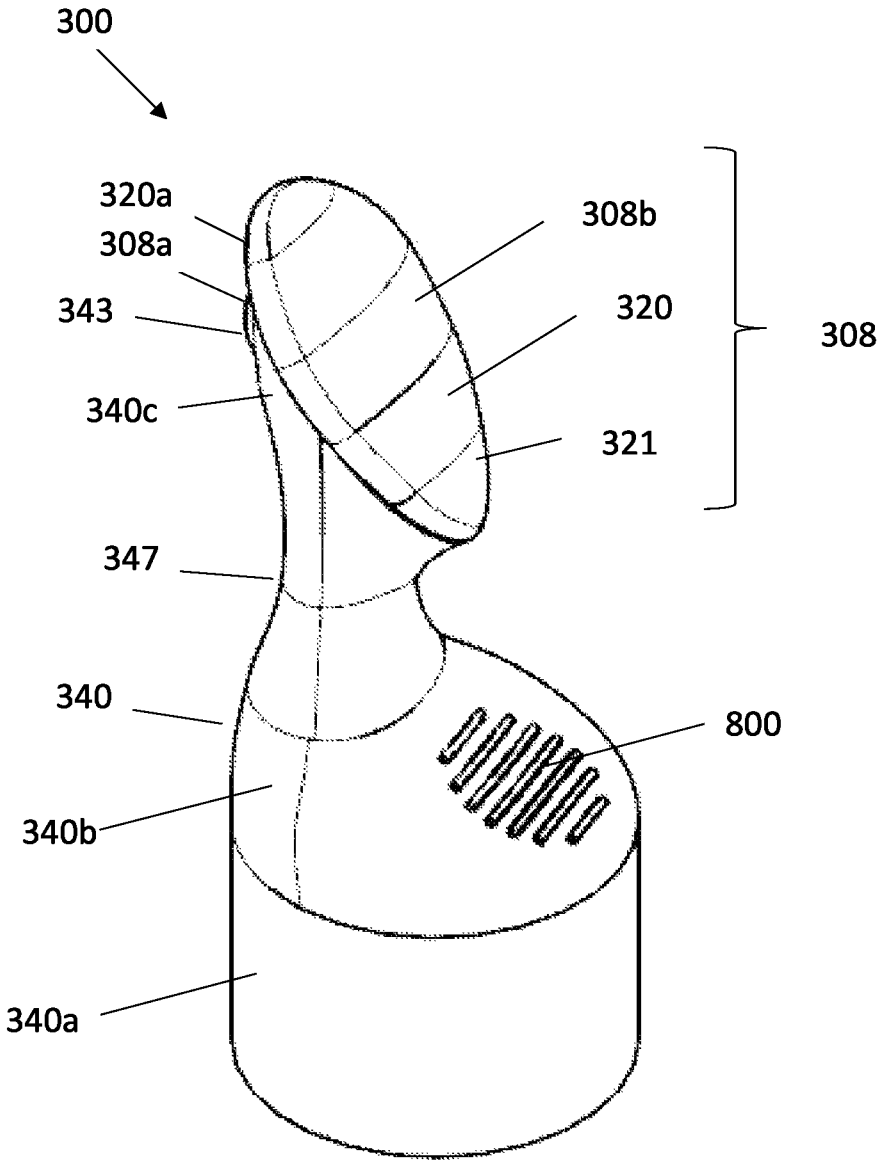
FIG. 4 illustrates an isometric view of an applicator head of the cosmetic package of FIG. 1.
Figure 5:
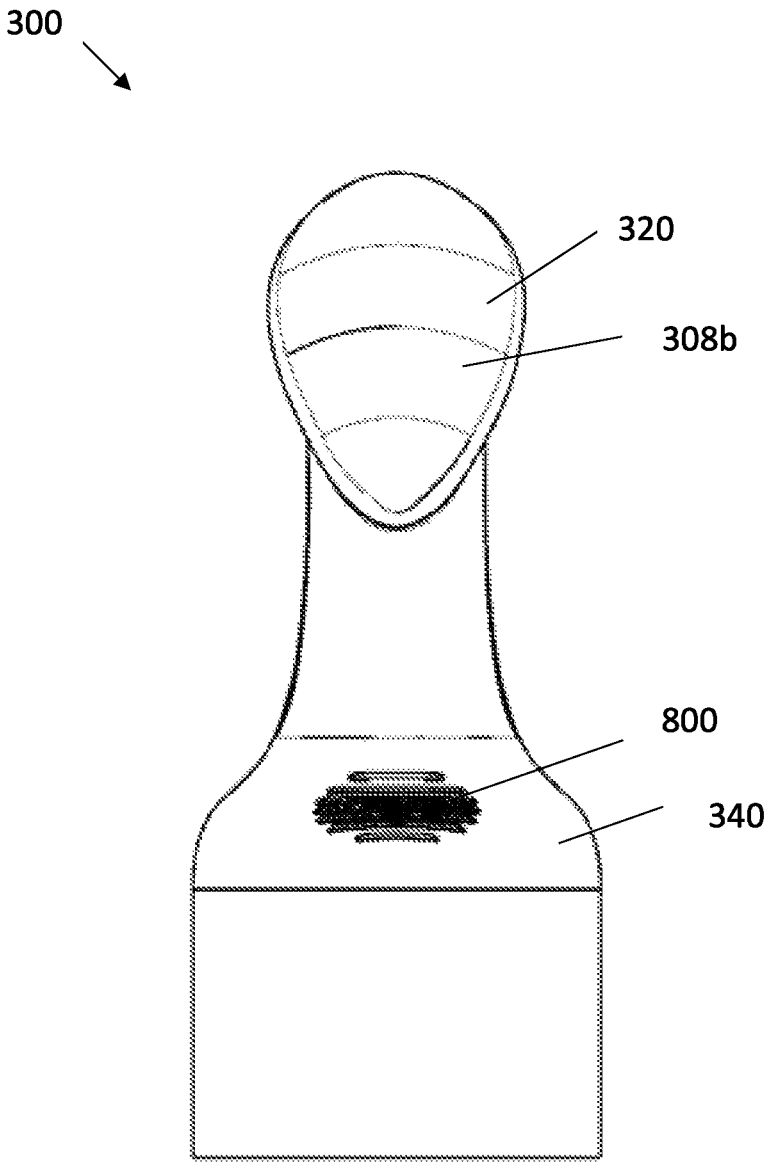
FIG. 5 illustrates a front view of the applicator head of FIG. 1.

As seen in FIG. 4, at least a portion of the applicator head 300 is formed as an applicator tip 308 that is adapted to apply and dispense the fluid product. More particularly, the applicator tip 308 is formed at an upper portion of the applicator head 300. The applicator tip 308 includes two main faces namely, a first face 308*a* and a second face 308*b* opposing the first face 308*a*.

Referring to FIGS. 3-6, the applicator head 300 is made of a dispensing member 340 and a thermal member 320. The thermal member 320 and at least an upper portion of the dispensing member 340 together define the applicator tip 308, refer FIG. 4. The dispensing member 340 includes a product delivery passageway 342 for the fluid product in communication with the housing 200, refer FIG. 2. The product delivery passageway 342 extends through the dispensing member 340 and ends in a dispensing opening 343 on the first face 308*a* of the applicator head 300 that is adapted to dispense and apply the fluid product on the surface to be treated.

Figure 7:
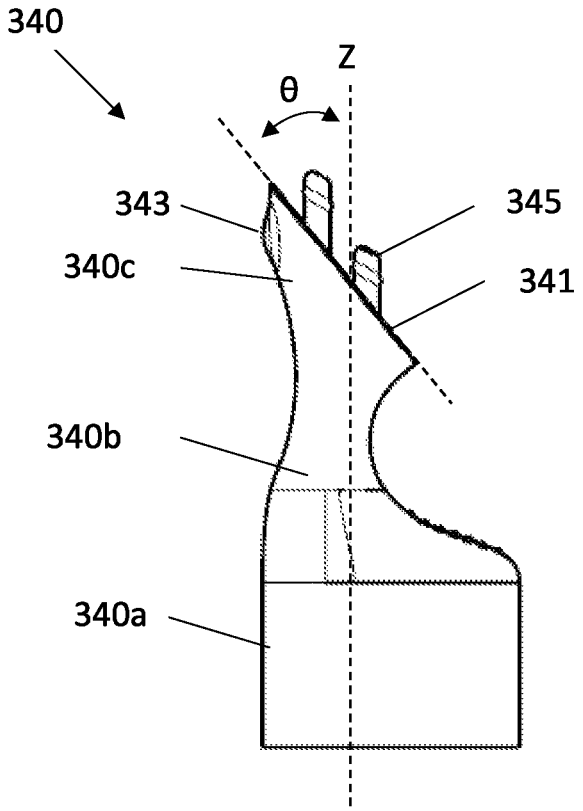
FIG. 7 illustrates a side view of a dispensing member of the applicator head of the cosmetic package of FIG. 2.

As seen in FIG. 7, the dispensing member 340 comprises a lower portion 340*a* that is configured to be connected to housing 200, a middle portion 340*b* that forms a neck portion 347 of the applicator head 300, and an upper portion 340*c* of the dispensing member 340 that forms a portion of the applicator tip 308 (FIG. 4).

Referring to FIG. 7, the lower portion 340*a* of the dispensing member 340 is cylindrical. The middle portion 340*b* of the dispensing member 340 gradually tapers asymmetrically from the a proximal end thereof up to a certain distance forming the neck portion 347 that is off-centered with respect to a longitudinal axis X of the cosmetic package 100 (see FIG. 2). The upper portion 340*c* of the dispensing member 340 includes a distal end face 341 that is inclined with respect to a longitudinal axis Z of the dispensing member 340 and faces the second face 308*b* of the applicator tip 308. A surface opposing the distal end face 341 of the dispensing member 340 forms a portion of the first face 308*a* and includes the dispensing opening 343 (see FIG. 2).

Figure 8:
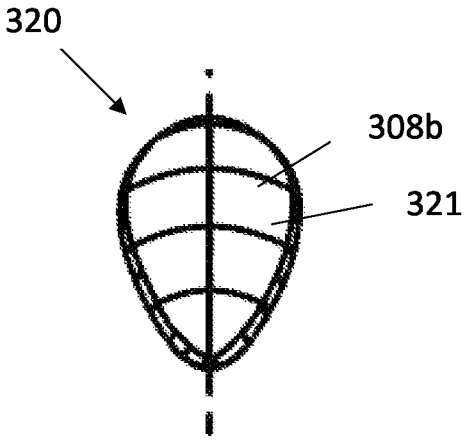
FIG. 8 illustrates a front view of a thermal member of the applicator head of the cosmetic package of FIG. 2.
Figure 9:
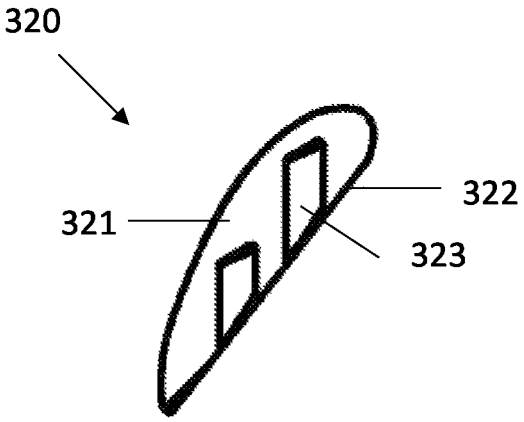
FIG. 9 illustrates a cross sectional view of the thermal member of the FIG. 8.

As seen in the FIG. 2, the thermal member 320 is attached to the dispensing member 340 on the distal end face 341 of the dispensing member 340. Referring to FIGS. 3 and 8-9, the thermal member 320 has a tear-shaped body. In the present embodiment, the tear-shaped body has an upper surface 321 that is convex and a bottom surface 322 that is flat. The tear-shaped body of the thermal member 320 has a wide distal end and a narrow proximal end. The upper surface 321 of the thermal member 320 forms the second face 308*b* of the applicator tip 308 intended to be applied on the user's surface to be treated. In addition, the second face 308*b* is adapted to perform, if necessary, a massage on the treated area. The second face 308*b* is available for use as a free, unhindered surface that can be entirely brought into contact with the part of the skin to be treated for the application of the cosmetic. Further, the thermal member 320 may be of any shape as long as it provides a relatively large continuous application area. In other words, the shape of the thermal member 320 may be constructed in any form and any suitable size with suitable mass and volume for the application purpose onto the user's keratinous surfaces.

In the present embodiment, a portion of a peripheral edge of the thermal member 320 is rounded for comfort during the application, as shown in FIG. 9. In alternate embodiments, the peripheral edge of the thermal member 320 may not be rounded.

Figure 6:
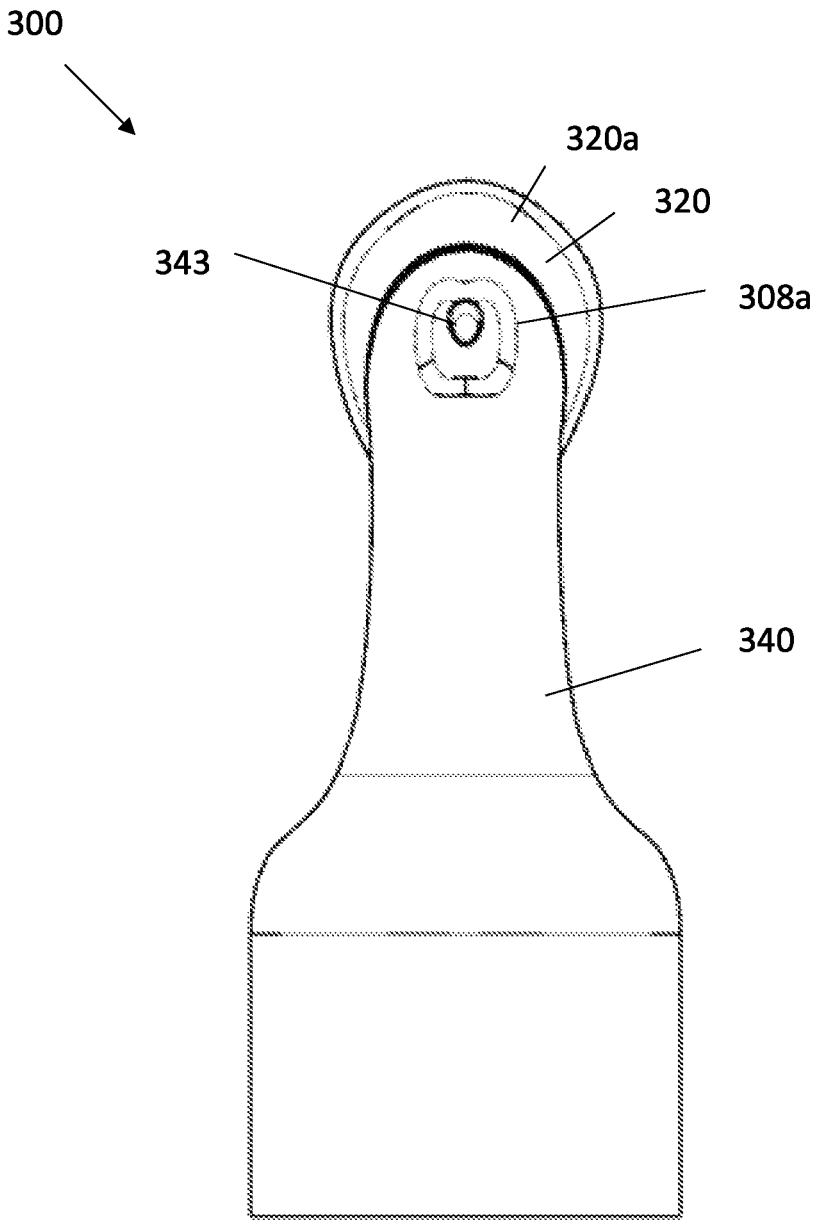
FIG. 6 illustrates a back view of the applicator head of FIG. 2.

Referring to FIGS. 2 and 6, the thermal member 320 protrudes from the distal end face 341 of the dispensing member 340 on at least three sides and most preferably at least extend beyond a top portion of a peripheral edge of the distal end face 341 of the dispensing member 340 forming a protruded thermal portion 320*a*. In alternate embodiments, the thermal member 320 protrudes from the distal end face 341 all the way around, i.e. on all sides.

The thermal member 320 may be secured to the dispensing member 340 on the distal end face 341, for example, by a press-fit, snap-fit, adhesive, and/or engagement by one or more engagement features or by any other means of engagement known in the art. In the exemplary embodiment, referring to FIGS. 2, 7 and 9, the distal end face 341 of the dispensing member 340 includes at least one coupling protrusion 345, preferably the at least two coupling protrusions 345 that are received in corresponding at least two coupling grooves 323 present at the bottom surface of the thermal member 320, in order to snap couple the thermal member 320 with the dispensing member 340. The two coupling protrusions 345 may be closely spaced or remotely spaced from each other. Additionally, each coupling protrusion 345 primarily secures precisely by means of snap or interference/fitment with the respective coupling groove 323.

FIG. 7 shows an angle θ of the distal end face 341 of the dispensing member 340 with respect to a longitudinal axis Z of the dispensing member 340. In the illustrated implementation, the angle θ is about 35°. This design facilitates the application of the thermal member 320 to the user's skin. However, other designs may be used. For example, in other implementations the angle θ may be between about 10° and about 75°. Still further implementations may have angles anywhere from 10° to 80°.

FIGS. 8 and 9, illustrates a front and cross-sectional view of the thermal member 320. In the current embodiment, the thermal member 320 includes the two coupling grooves 323 that extend longitudinally, and they extend from the bottom surface 322 to a certain depth. Additionally, the two coupling grooves 323 can be constructed of any diameter and depth. Further, the thermal member of 320 may be of any shape or include various structures.

As seen in FIGS. 6 and 7, the dispensing member 340 comprises the dispensing opening 343 near a distal end of the dispensing member 340 on the first face 308*a* of the applicator tip 308. An outer surface surrounding the dispensing opening 343 near a distal end of the dispensing member 340 on the first surface 308*a* is protruded, thus the dispensing opening 343 in the present embodiment is a protruded dispensing opening 343. In other words, the dispensing opening 343 is a protruded structure formed on dispensing member 340 on the first face 308*a*. The protruded thermal portion 320*a* of the thermal member 320 that extends beyond atop peripheral edge of the distal end face 341 of the dispensing member 340 together with the protruding dispensing opening 343 defines the first face 308*a* of the applicator tip 308. The protruding dispensing opening 343 lies close below the protruded thermal portion 320*a* of the thermal member 320. Thus, during the application, when the fluid product is applied from the dispensing opening 343, both the protruded dispensing opening 343 and the protruded thermal portion 320*a* of the thermal member 320 of the first face 308*a* come in contact with the user's target area for application. More particularly, when the fluid product is applied from the dispensing opening 343, the dispensing opening 343, at least a portion of the bottom surface 322 of the thermal member 320 near a peripheral edge of the thermal member 320, and at least a portion of a peripheral edge of the thermal member 320 of the first face 308*a* come in contact with the user's target area for application. The first face 308*a* thus may be used for applying the dispensed fluid product and as well as providing thermal sensation to the user's skin. Thus, in the exemplary embodiment, the first face 308*a* wherein the protruded thermal portion 320*a* is configured in such a way that it preferably touches/contacts the user's keratinous surface and provides thermal massage i.e., heating or cooling on to the keratinous surface during or after dispensing of the fluid product from the dispensing opening 343.

As shown in FIG. 4, the applicator tip 308 thus comprises two faces i.e. the first face 308*a* and the second face 308*b*. More particularly, the first face 308*a* consists of the protruded thermal portion 320*a* defined at a top of the applicator tip 308 and at least one dispensing opening 343 placed below the protruded thermal portion 326. Further, the second face 308*b* is a thermal surface that is on the opposite side of the first face 308*a*. The second face 308*b* is a thermal surface defined by the upper surface 321 of the thermal member 320 that allows the users to massage a larger area of the keratinous surface.

The protruded thermal portion 320*a* of the thermal member 320 enables precise massage of small or narrow areas of the user's keratinous surface such as upper lips, under eye, etc. Herein, the disclosed protruded thermal portion 320*a* of the thermal member 320 at the top of the dispensing member 30 is a continuous surface. The protruded thermal portion 320*a* of the thermal member 320 is positioned adjusted in such a manner with the protruded dispensing opening 343 so that it is substantially parallel to the protruded dispensing opening 343 and allows the user to massage the small or narrow areas of a keratinous surface while dispensing the fluid product on to the user's keratinous surface.

The thermal member 320 is made of a material with high thermal effusivity compared to that of the user's surface to be treated. The thermal effusivity of the thermal member 320 is higher than that of the dispensing member 340.

Thermal member 320 made of a material capable of holding and retaining a thermal charge. In one implementation, the thermal member 320 can be made of stainless steel. However, in other implementations, any suitable material may be used that is capable of retaining heat or cold during the application of the fluid product. Examples of other suitable materials include, without limitation, metals (e.g., aluminum, titanium, steel, nickel, tin, copper, brass, alloys thereof, etc.) stones, ceramics, high-density plastics, composites, or the like.

The dispensing member 340 may be made of a thermoplastic polymer, for example, which is non-reactive with the fluid product stored in the reservoir 201. In other implementations, the dispensing member 340 may be made of virtually any other material that is non-reactive or resistant to the fluid product being dispensed, such as various metals, plastics, ceramics, composites, or the like.

In this implementation, see FIGS. 8 and 9, the thermal member 320 is shown as being a tear shaped body. In alternate embodiments, however, the thermal member 320 may be constructed in any other suitable shape and size and may have any suitable mass, surface finish desired for a given application. For example, the thermal member 320 may be a flat or essentially flat plate.

As shown in FIG. 2, at least a portion, preferably a major portion 342*a* of the product delivery passageway 342, which forms a dispensing path for the fluid product in housing 200, is off-centered and parallel to the longitudinal axis X of the cosmetic package 100. A distal portion 342*b* of the product delivery passageway 342 is non-parallel to the longitudinal axis X of the cosmetic package 100, preferably the distal portion 342*b* of the product delivery passageway 342 is slanted and opens into the dispensing opening 343 on the first face 308*a*.

Referring to FIG. 2 to 3, the cosmetic package 100 according to an exemplary embodiment further includes the housing 200, a support body 400, a pumping member 500, a contents movement part 600, piston member 250, and a button 800 (see FIG. 4) formed on an outer surface of the middle portion 340*b* of the dispensing member 340

Referring to FIGS. 2-3, the housing 200 is provided with a coupling part 210 at an upper portion thereof for coupling with a support body 400. The support body 400 includes a coupling part 401 coupled to the coupling part 210 at an upper portion of the housing 200. The support body 400 is configured to support a pumping member 500, is provided with a hollow U-shaped wall 412 for coupling with a pumping member 500.

The cosmetic package further includes a cap 120 made up of glass or plastic with protrusions 121 (see FIG. 2) at an inner surface of a lower portion of a sidewall of the cap 120. Advantageously, each protrusion 121 gets in snap-fit connection with a corresponding protrusion 411 (see FIG. 3) present on an outer surface of the support body 400. In alternate embodiments, the cap 120 and the housing 200 may be coupled. The coupling means between the cap 120 and the support body 400/housing 200 may by any other engagement means capable of removably coupling the cap 120 and the support body 400/the housing 200 for e.g. j-lock, magnetic engagement, screw threads etc.

Referring to FIG. 2, the pumping member 500 is coupled to the support body 400 and performs a pumping operation for discharging fluid product stored in the housing 200 to the outside. The pumping member 500 further includes a cup-shaped body 504, an annular fluid-tight piston 512, a check valve 506, a spring 502, and a hollow elongated stem 508. The check valve 506 is disposed on a proximal end of the cup-shaped body 504. The check valve 506 allows a one-way suction of the fluid product stored inside the housing 200, wherein the one-way suction is typically from the proximal end to the distal end of the pumping member 500. The pumping member 500 comprises the cup-shaped body 504 delimiting a chamber 504*a* for suction/compression of the fluid product to be dispensed, in which the hollow stem 508 extends at least partially. The pumping member 500 of such construction belongs to a prior art; therefore, detailed description will be limited.

Referring to FIG. 2, the support body 400 includes an upper sidewall 403 that encases the pumping member 500 at an upper portion of the housing 200. The upper sidewall 403 of the support body 400 comprises a button insertion hole 410 such that when the button 800 is pressed the lower portion 340*a* of the dispensing member 340 can be slidably inserted therein.

As shown in FIG. 2, the contents movement part 600, disposed at an upper portion of the pumping member 500 at an inner side of lower portion 340*a* of the dispensing member 340, and moves fluid product which move to an upper portion thereof through a pumping operation of the pumping member 500 to the dispensing opening 343. The contents movement part 600, comprises a body 610 encasing an upper portion of the pumping member 500; a button fixation protrusion 611 extending from an upper surface of the body 610 to an upward direction and fixes to the inner side of the lower portion 340*a* of the dispensing member 340; a movement tube 612 provided with a passage where fluid product flowing out by a pumping operation of the pumping member 500 move; and movement tube 612 guides the movement of fluid product so as to move the fluid product flowing in by a pumping operation of the pumping member 500 to the product delivery passageway 342.

The movement tube 612 of the contents movement part 600 is coupled to an upper portion of the pumping member 500 and communicates with the pumping member 500.

When the contents movement part 600 moves to a downward direction by pressurization of the button 800 formed on the outer surface of the middle portion 340*b* of the dispensing member 340, the fluid product is discharged by a pumping action of the pumping member 500, and the fluid product is discharged to the outside on the first face 308*a* through the dispensing opening 343.

The lower portion 340*a* of the dispensing member 340, inserted into a button insertion hole 410 of the support body 400 and descends by the user's pressing, and then ascends by an elastic force of the spring 502 of the pumping member 500 when the pressing is released. Next, when the button 800 is released from being pressurized, the contents movement part 600 ascends by the spring 502 of the pumping member 500 and restores the button 800 coupled to an upper portion of the contents movement part 600 to the original place.

As shown in FIG. 2, a piston member 250 is sealingly and slidingly received in the housing 200. The piston member 250 is movable along the longitudinal axis X in the housing in response to the pumping action and reaches near an open proximal end of the housing 200 when the fluid product inside the housing 200 is completely used.

In the present embodiment, a delivery mechanism for dispensing product is an airless pump. However, in other implementations, any suitable delivery mechanism may be used.

The following is a discussion of examples, without limitation, of delivery mechanisms for dispensing a fluid product. The first example may be implemented using a click or a reverse click operation, whereby the user may operate the cosmetic package 100 by moving the applicator head 300 relative to the housing 200 in either a clockwise or counterclockwise direction.

Another example delivery mechanism for dispensing the fluid product may be a squeeze operation. In certain embodiments wherein the delivery mechanism is a squeeze operation, when pressure is applied to the housing 200 containing the reservoir 201, the fluid product in the reservoir 201 may be forced, by the squeezing action, through the cosmetic package 100 via a product delivery passageway 342 for application to the user's skin.

In yet another example, a delivery mechanism for dispensing the fluid product may be by a pressurized dispenser, such as an aerosol dispenser. In certain embodiments wherein the delivery mechanism is an aerosol delivery mechanism, the composition will be held under pressure in a housing and will be dispersed along with an aerosol propellant in response to actuation by a user. Actuation may be by depressing, rotating, tilting, or otherwise manipulating the applicator head, pressing a button, and/or by any other suitable dispensing mechanism. Details of the construction and propellant of an aerosol dispenser are within the skill of one of ordinary skill in the art and will, therefore, not be described in detail herein.

In some embodiments, thermal member 320 is selected from glass, stones, ceramics or metals, wherein the metal is selected from but not limited to silver, stainless steel, platinum, aluminum, gold, copper, brass, nickel, alloys thereof.

According to an aspect of the present disclosure, the cosmetic package 100 is of an elongated cylindrical configuration. However, in alternate embodiments, the cosmetic package 100 may be of an elongated square, polygonal configuration, oval, triangular, heart, or any other configuration known in the art.

According to an embodiment, the housing 200 and the cap 120 may be made of a rigid material like glass, metal, hard plastic or any other material known in the art. However, in alternate embodiments, the housing 200 and the cap 100 may be made of a flexible material like flexible polymeric material or any other material known in the art.

According to an embodiment of the present disclosure, at least a part and preferably all of the dispensing member 340 can be made by molding, e.g. by injection-molding, e.g. in a material selected from the following list: thermoplastic materials; elastomers; thermoplastic elastomers; thermoplastic elastomer polyester such as HYTREL®, for example; nitrile rubber; silicone rubber; ethylene-propylene terpolymer rubber (EPDM); styrene-ethylene-butylene-styrene (SEBS); styrene-isoprene-styrene (SIS); polyurethane (PU); ethyl vinyl acetate (EVA); polyvinyl chloride (PVC); polyethylene (PE); polyethylene terephthalate (PET); polypropylene (PP); this list not being limiting.

It will be understood that the foregoing is only illustrative of the principles of the disclosure, and that various modifications can be made by those skilled in the art without departing from the scope and spirit of the disclosure. For example, the shapes and/or sizes of various components can be different from the shapes and sizes shown herein. As another example, the materials used for various components can be different from those mentioned specifically herein.

What is claimed is:

1. A cosmetic package for dispensing and applying a fluid product, comprising:

a housing for storing the fluid product therein;

an applicator head coupled to one end of the housing;

wherein a portion of the applicator head is formed as an applicator tip that is configured to apply and dispense the fluid product;

wherein the applicator tip includes a first face and a second face opposing the first face;

wherein the applicator head comprises a dispensing member and a thermal member;

wherein the thermal member and at least an upper portion of the dispensing member together define the applicator tip;

wherein the thermal member is attached to the dispensing member on a distal end face of the dispensing member;

wherein the thermal member comprises a protruded thermal portion that protrudes from at least a top portion of a peripheral edge of the distal end face of the dispensing member;

wherein a product delivery passageway extends through the dispensing member and ends in a dispensing opening near a distal end of the dispensing member on the first face;

wherein the dispensing opening is a protruded structure formed on dispensing member on the first face;

wherein the first face of the applicator tip includes the protruded thermal portion and the dispensing opening of the dispensing member;

wherein the second face of the applicator tip is defined by an upper surface of the thermal member;

wherein the dispensing opening is located closely below the protruded thermal portion of the thermal member on the first face such that when the fluid product is applied from the dispensing opening, both the dispensing opening and the protruded thermal portion of the thermal member of the first face come in contact with the user's target area for application.

2. A cosmetic package according to claim 1, wherein the protruded thermal portion of the thermal member is axially aligned with the dispensing opening; wherein the dispensing opening is protruding from an outer surface of the dispensing member.

3. A cosmetic package according to claim 1, wherein the dispensing member comprises a lower portion that is configured to be connected to the housing, a middle portion that forms a neck portion of the applicator head, and an upper portion of the dispensing member that forms a portion of the applicator tip.

4. A cosmetic package according to claim 3, wherein the lower portion of the dispensing member is cylindrical, wherein the middle portion of the dispensing member gradually tapers asymmetrically from a proximal end thereof up to a certain distance forming the neck portion which is off-centered with respect to a longitudinal axis of the cosmetic package.

5. A cosmetic package according to claim 1, wherein an upper portion of the dispensing member includes the distal end face which is inclined with respect to a longitudinal axis of the dispensing member; wherein the distal end face of the dispensing member makes a non-zero angle $\theta$ with respect to the longitudinal axis of the dispensing member; wherein the non-zero angle $\theta$ is between 10°-80°.

6. A cosmetic package according to claim 1, wherein the thermal member has a tear-shaped body and wherein the tear-shaped body of the thermal member has the upper surface that is convex and a bottom surface that is flat; wherein the tear-shaped body has a wide distal end and a narrow proximal end.

7. A cosmetic package according to claim 1, wherein the thermal member is made of a material capable of holding and retaining a thermal charge; and wherein the material is selected from a group consisting of metals, metal alloys, stones, ceramics, high-density plastics, and composites; and wherein a thermal effusivity of the thermal member is higher than that of a thermal effusivity of the dispensing member.

8. A cosmetic package according to claim 1, wherein the distal end face of the dispensing member includes at least one coupling protrusion that is received in a corresponding at least one coupling groove present at a bottom surface of the thermal member to snap couple the thermal member with the dispensing member.

9. A cosmetic package according to claim 1, wherein a major portion of the product delivery passageway of the dispensing member is off-centered and parallel to the longitudinal axis of the cosmetic package; and wherein a distal portion of the product delivery passageway is non-parallel and is slanted with respect to the longitudinal axis of the cosmetic package; and wherein the applicator tip is off-centered with respect to the longitudinal axis of the cosmetic package.

10. A cosmetic package according to claim 1, wherein the cosmetic package includes a support body, a pumping member, a contents movement part, a button formed on an outer surface of the middle portion of the dispensing member, and a piston member sealingly and slidingly received in the housing; wherein the support body is coupled at an upper portion of the housing and is configured to support the pumping member; wherein the pumping member is configured to do a pumping operation for discharging the fluid product stored in the housing of the applicator tip; and wherein the pumping member includes a cup-shaped body, an annular fluid-tight piston, a check valve, a spring, and a hollow elongated stem.

11. A cosmetic package according to claim 10, wherein the support body includes an upper sidewall that comprises a button insertion hole such that when the button is pressed, a lower portion of the dispensing member can be slidably inserted therein; wherein the contents movement part is disposed at an upper portion of the pumping member at an inner side of the lower portion of the dispensing member for moving the fluid product to the product delivery passageway through the pumping operation of the pumping member to the dispensing opening.

12. A cosmetic package for dispensing and applying a fluid product, comprising:

a housing for storing the fluid product therein;

an applicator head coupled to one end of the housing;

wherein an upper portion of the applicator head is formed as an applicator tip that is configured to apply and dispense the fluid product;

wherein the applicator tip includes a first face and a second face opposing the first face;

wherein the applicator head comprises a dispensing member and a thermal member;

wherein the thermal member and at least an upper portion of the dispensing member together define the applicator tip;

wherein the thermal member is attached to the dispensing member on a distal end face of the dispensing member;

wherein the second face of the applicator tip is defined by an upper surface of the thermal member;

wherein the distal end face of the dispensing member is inclined with respect to a longitudinal axis of the applicator head;

wherein the second face of the applicator tip is inclined with respect to the applicator head;

wherein a product delivery passageway extends through the dispensing member and ends in a dispensing opening near a distal end of the dispensing member on the first face of the applicator tip;

wherein the dispensing opening is located closely below a portion of a peripheral edge of the thermal member near a distal end of the dispensing member on the first face; and wherein during the application, when the fluid product is applied from the dispensing opening, at least a portion of a bottom surface of the thermal member and at least a portion of the peripheral edge of the thermal member of the first face come in contact with the user's target area for application.

13. A cosmetic package according to claim 12, wherein the thermal member is made of a material capable of holding and retaining a thermal charge; and wherein the material is selected from a group consisting of metals, metal alloys, stones, ceramics, high-density plastics, and composites.

14. A cosmetic package according to claim 12, wherein the dispensing member comprises a lower portion that is configured to be connected to the housing, a middle portion that forms a neck portion of the applicator head, and an upper portion of the dispensing member forms a portion of the applicator tip; wherein the middle portion and the upper portion of the dispensing member is off-centered with respect to a longitudinal axis of the cosmetic package.

15. A cosmetic package according to claim 12, wherein the thermal member has a tear-shaped body, and wherein the tear-shaped body of the thermal member has the upper surface that is convex and the bottom surface that is flat.

16. A cosmetic package according to claim 12, wherein the distal end face of the dispensing member includes at least two coupling protrusions that are received in corresponding at least two coupling grooves present at the bottom surface of the thermal member to snap couple the thermal member with the dispensing member.

17. An applicator head for dispensing and applying a fluid product, comprising:

an applicator tip adapted to apply and dispense the fluid product;

wherein the applicator tip includes a first face and a second face opposing the first face;

wherein the applicator head comprises a dispensing member and a thermal member;

wherein the thermal member and at least an upper portion of the dispensing member together define the applicator tip;

wherein the thermal member is attached to the dispensing member on a distal end face of the dispensing member;

wherein the second face of the applicator tip is defined by at least by an upper surface of the thermal member;

wherein a product delivery passageway extends through the dispensing member and ends in a dispensing opening near a distal end of the dispensing member on the first face of the applicator tip;

wherein the distal end face of the dispensing member and the second face of the applicator tip are both inclined with respect to a longitudinal axis of the applicator head;

wherein the distal end face of the dispensing member includes at least two coupling protrusions, wherein a bottom surface of the thermal member includes at least two coupling grooves; and wherein the at least two coupling protrusions are received in the corresponding at least two coupling grooves of the thermal member.

18. A applicator head according to claim 17, wherein the thermal member is made of a material capable of holding and retaining a thermal charge; and wherein the material is selected from a group consisting of metals, metal alloys, stones, ceramics, high-density plastics, and composites.

19. An applicator head according to claim 17, wherein the thermal member comprises a protruded thermal portion that protrudes from at least a top portion of a peripheral edge of the distal end face of the dispensing member; wherein the dispensing opening lies close below the protruded thermal portion of the thermal member on the first face such that when the fluid product is applied from the dispensing opening, both the dispensing opening and the protruded thermal portion of the thermal member of the first face come in contact with the user's target area for application.

20. An applicator head according to claim 17, wherein the distal end face of the dispensing member makes a non-zero angle with respect to a longitudinal axis of the dispensing member; and wherein the non-zero angle is between 10°-80°.

21. An applicator head according to claim 17, wherein the thermal member has a tear-shaped body, and wherein the tear-shaped body of the thermal member has the upper surface that is convex and a bottom surface that is flat.

* * * * *